US006579131B1

(12) United States Patent
Ashcraft et al.

(10) Patent No.: US 6,579,131 B1
(45) Date of Patent: Jun. 17, 2003

(54) SLIP-FIT TRANSFORMER STUD ELECTRICAL CONNECTOR

(75) Inventors: Thomas K. Ashcraft, Ft. Mitchell, KY (US); Jefferson Butler, Dallas, TX (US); Raymond Olle, Seven Hills, OH (US)

(73) Assignee: Connector Manufacturing Company, Hamilton, OH (US)

( * ) Notice: Subject to any disclaimer, the term of this patent is extended or adjusted under 35 U.S.C. 154(b) by 0 days.

(21) Appl. No.: 08/922,222

(22) Filed: Sep. 2, 1997

(51) Int. Cl.[7] ..... H01R 11/09
(52) U.S. Cl. ..... 439/798; 439/814
(58) Field of Search ..... 439/798, 797, 439/796, 814, 921

(56) References Cited

U.S. PATENT DOCUMENTS

| | | | | |
|---|---|---|---|---|
| 2,431,999 | A | 12/1947 | Engelhardt | |
| 2,764,749 | A | 9/1956 | Aberle | |
| D195,623 | S | 7/1963 | Leonardo | |
| 3,133,779 | A * | 5/1964 | Stanback | 439/798 |
| 3,382,478 | A | 5/1968 | Satterthwait | |
| 3,652,977 | A | 3/1972 | Feldberg | |
| 3,874,760 | A | 4/1975 | Guthmiller et al. | |
| 4,214,806 | A | 7/1980 | Kraft | |
| 4,382,651 | A * | 5/1983 | Klosin et al. | 439/359 |
| 4,513,169 | A | 4/1985 | McGrane | |
| 4,547,627 | A | 10/1985 | McGrane | |
| 4,785,378 | A | 11/1988 | Hinckley et al. | |
| D302,420 | S | 7/1989 | McGrane | |
| D306,716 | S | 3/1990 | Shimirak | |
| D309,664 | S | 7/1990 | McGrane | |
| D317,434 | S | 6/1991 | McGrane | |
| D317,435 | S | 6/1991 | McGrane | |
| D320,381 | S | 10/1991 | McGrane | |
| 5,201,678 | A | 4/1993 | Venezia | |
| 5,690,516 | A * | 11/1997 | Fillinger | 439/798 |

FOREIGN PATENT DOCUMENTS

| | | |
|---|---|---|
| FR | 1229880 | 9/1960 |
| GB | 2085672 | 4/1982 |

OTHER PUBLICATIONS

"Dual Rated Solderless Lugs" ILSCO Pocket Guide, Revised Edition, 1985, pp. 3–6.
"Dual Rated Solderless Lugs" Connector Manufacturing Co. Brochure, revised Oct. 20, 1986, pp. 7–8.
"Homac's ZeeBar Disconnectable Secondary Transformer Connector" Homac Mfg. Company Oct. 1987.
"A Totally New Concept in Safety & Reliability" Homac Mfg. Company, date unknown.
"Power Distribution Blocks" Electrical System Distributer, Sep. 1988, p. 50.

* cited by examiner

*Primary Examiner*—Gary Paumen
*Assistant Examiner*—Antoine Ngandjui
(74) *Attorney, Agent, or Firm*—Kremblas, Foster, Phillips & Pollick

(57) ABSTRACT

An electrical connector for transformer studs accommodates two different size transformer studs in the same slip-fit blind hole. The hole is provided with circumferential arc recesses which are sized and threaded to match the threads on the two different size studs. One or more jam screws force the stud into the respective recesses, and the matching threads provide a substantial contact area and an effective and efficient long lasting and sturdy electrical transformer connection.

15 Claims, 2 Drawing Sheets

SLIP-FIT TRANSFORMER STUD ELECTRICAL CONNECTOR

DISCLOSURE

This invention relates generally as indicated to a slip-fit transformer stud electrical connector, and more particularly, a connector which accommodates in the same slip-fit hole two different transformer stud sizes.

BACKGROUND OF THE INVENTION

This invention relates to certain improvements in transformer stud electrical connectors as shown in the copending application of David R. Fillinger, Ser. No. 08,502,830, filed Jul. 14, 1995, and entitled "Transformer Stud Electrical Connector" now U.S. Pat. No. 5,690,516.

In power distribution, transformers are provided with extending threaded studs which are usually copper. Stud connectors are secured to such studs and a number of conductors are in turn secured to the connectors. Typically, the stud connector has an elongated body of conductive material such as aluminum with a stud receiving hole in one end and a plurality of transverse holes or ports in which the conductors are clamped by set screws, for example. The bottoms of the holes or ports form pads against which the conductors are clamped by the set screws.

For many years transformer stud connectors have been supplied in two styles: the slip-fit and the screw-on. The screw-on version has an internal thread in the connector matching the thread on the transformer stud and is installed by rotating the connector onto the threaded stud. Since the stud is of considerable length, a large number of revolutions of the connector is required to seat and lock the connector on the stud. The exact position of the connector on the stud usually requires the tightening of a lock nut against the connector.

The slip-fit usually has an oversized threaded hole compared to the stud diameter. The connector is installed by sliding the oversized connector over the threaded stud and tightening a jam screw from the top side of the connector to force the internal and external threads to mesh. The contact area is less than a perfect fit since the diameters do not match and the threads between the stud and connector do not completely seat. Moreover, the contact between the stud and the connector occurs only along a very narrow strip along the bottom of the stud. Also, as a result of the limited interface, the connector has a tendency to pivot when pressure is applied to the outer end of the connector, especially when additional conductors are installed.

Attempts to stabilize the connection are seen in Kraft U.S. Pat. No. 4,214,806 where the stud is forced against parallel edges to achieve a two line contact or triangular locking arrangement including the jam screw. The surface area of pressure contact is still minimal.

More recently, a stud connector sold by Erico, Inc. under the trademark SHARK™, and as shown in the above noted copending application of David R. Fillinger, utilizes an oversize unthreaded hole and an intersecting smaller threaded hole with threads matching those of the stud. Opposite jam screws force the matching threads together providing good high pressure, large surface area, electrical contact with improved stability. The much larger surface area contact provides a cooler running connection avoiding heat degradation or burnout.

A major problem is that transformer studs come in two different sizes, typically ⅝" and 1". Earlier stud connectors were stocked in two different sizes to accommodate both stud sizes. More recently, tiered connector designs often incorporate openings for both stud sizes, with the ⅝" stud opening generally located on the upper tier, and the 1" stud opening located on the bottom tier. While this arrangement avoids the necessity of stocking two different connectors, it nonetheless requires that valuable space be wasted on any connector when both stud holes are present, but only one is utilized.

Another method of incorporating openings for both stud sizes involves forming the two size stud openings in opposite ends of the connector, along the axis of the conductor row. While this also eliminates the need for two separate connectors, the wasted material and space is the same. A stud hole on both ends also lengthens the connector, increasing any cantilever stress on the stud and connection.

Another problem associated with this style of connector is that the orientation of the set screws changes depending on the stud size used. Generally, connectors are referred to as either left hand or right hand in configuration, when looking at the front of the connector. In a left hand configuration, when the connector is placed on the stud, the set screws for the conductor ports are on the left hand side of the connector. Turning the connector around to utilize the opposite stud opening will usually reverse the orientation of the set screws. Thus, changing from one stud size to another may mean giving up the ability to choose the orientation of the set screws.

It would, accordingly, be desirable to have a connector which combines the tight fit of the screw-on connection with the easier and quicker installation of the slip-fit connector, while at the same time providing a much improved electrical connection in the same single slip-fit hole for two different size transformer studs.

SUMMARY OF THE INVENTION

The present invention accommodates both stud sizes in a single opening. The hole is formed using at least three centers, with the centers aligned usually vertically. The diameters formed on the centers are each of a different size. The largest opening is the clearance opening, designed to allow insertion of a 1-14 threaded stud. The intermediate opening incorporates a 1-14 threaded, semicircular opening with the center sharing the same vertical axis as the first opening, but located slightly below or offset the center of the larger opening. The third opening incorporates a ⅝-11 threaded hole, with the center again sharing a common vertical alignment, but located slightly lower than or offset from the second center. In this manner, a single stepped opening accommodates either stud size, while simultaneously allowing sufficient surface area or thread engagement to ensure both a rigid and firm physical connection and a good electrical connection for either size stud.

The invention then provides a transformer stud electrical connector which has an electrically conducting connector body having a blind stud receiving hole which will accommodate at least two different size studs, the hole having circumference arcs formed by arcs having at least three centers, and each of a different radius. The centers of the arcs are offset from each other yet aligned, normally vertically. One or more jam screws have an axis on the alignment and force an inserted stud into one or another of the arcs formed by the smaller radii. The smaller radii arcs are respectively threaded to match the threads on the respective studs accommodated. The intermediate radius forms two arcs, with the arc formed by a smaller radius positioned between the two arcs, and bisecting the intermediate radius arcs. The connector is formed by drilling the blind stud receiving hole on the at least three centers which are aligned with the axis of the jam screw hole or holes. Threads are then formed on all but the largest hole surface which match the threads of the different studs.

One significant advantage of the invention is that no material is wasted on a second stud opening, permitting for a shorter, lighter connector, which reduces the cantilever stress on the transformer stud. Another benefit is that it permits the same set screw orientation regardless of stud size being utilized. They do not have to be turned end-for-end. Connectors are supplied in either a left hand or right hand configuration, regardless of required stud size, and the orientation of the set screws remains the same for either stud.

This invention is useful on any style of stud connector, wherever an application exists for different stud sizes.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
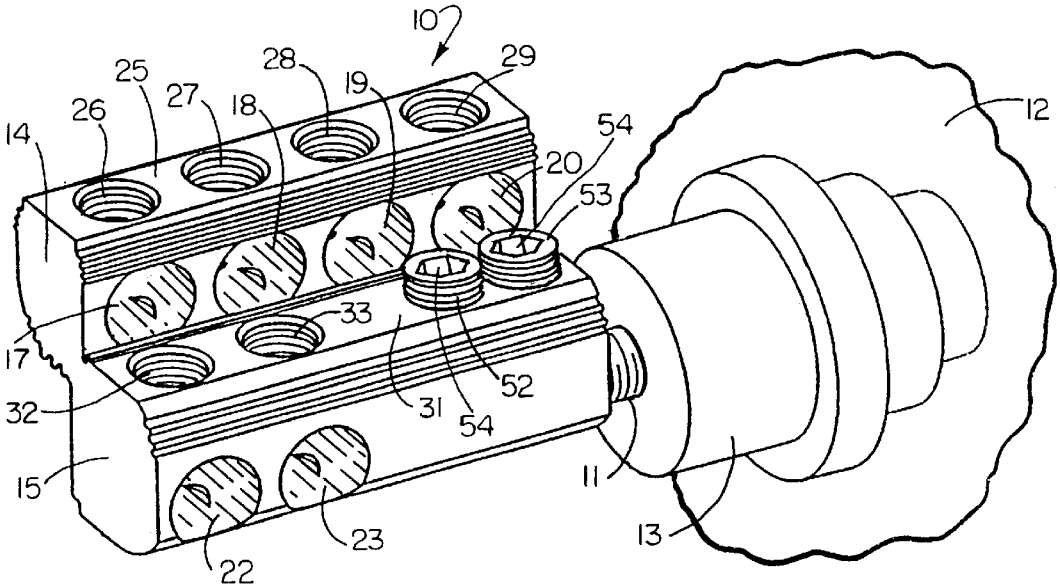
FIG. 1 is a fragmentary isometric illustration of the body of a connector in accordance with the invention mounted on a transformer stud.
Figure 2:
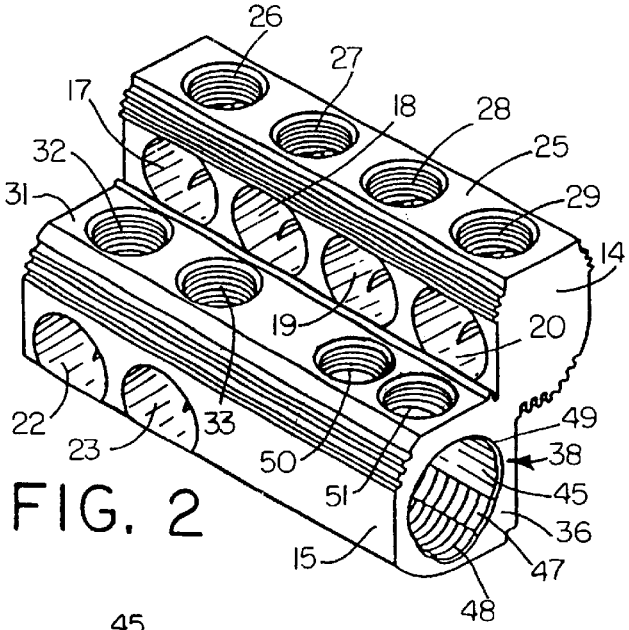
FIG. 2 is another similar illustration of the connector body without the screws showing the slip-fit stud hole for accommodating the two sizes of transformer studs.
Figure 3:
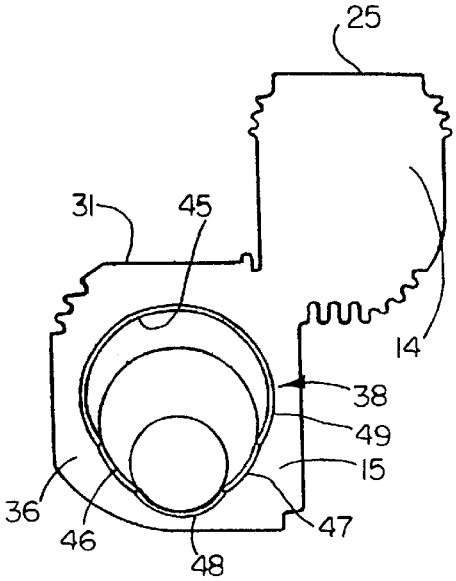
FIG. 3 is an end view of the connector body and the profile of the blind hole for accommodating the transformer studs.

Referring initially to FIGS. 1–3 there is illustrated one form of slip-fit stud connector in accordance with the present invention shown generally at 10 and secured to transformer stud 11 extending from transformer 12 through bushing 13. The electric utility industry utilizes such transformers to distribute electricity to various end users. A typical example would be in a subdivision. The transformers may be surface mounted (padmount), or located below grade. The padmount style of transformer is generally enclosed is a steel cabinet and utilizes the threaded copper studs 11 to transfer current supplied through the primary connections to the secondary connectors 10 illustrated. The secondary connectors are typically manufactured from aluminum to accommodate aluminum conductors which are most commonly used for distribution.

The connector 10 illustrated is a tiered or stepped connector including an upper portion 14 and a larger lower portion 15. The connector may be of the type sold by Erico, Inc. of Solon, Ohio, under the trademarks ESP® and SHARK™. The aluminum conductors are inserted in generally horizontal port openings seen at 17, 18, 19 and 20 in the upper tier, and at 22 and 23 in the lower tier.

Extending transversely of the port openings 17–20 from the top surface 25 of the upper tier 14 are tapped holes 26, 27, 28 and 29, respectively. These tapped holes or openings accommodate jam or set screws which are used to clamp the end of the conductors in place in the respective ports. Similarly, the top surface of the lower tier indicated at 31 is provided with transverse tapped holes 32 and 33 for the lower ports 22 and 23, respectively.

Figure 4:
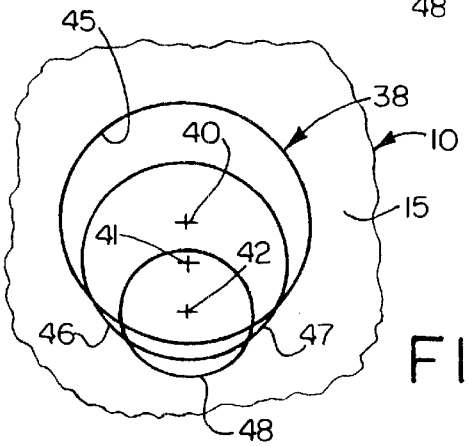
FIG. 4 is an axial schematic of the hole showing the formation and arrangement of the circumference arcs of the hole walls.

Referring now more particularly to FIGS. 2–4, it will be seen that the right hand end face of the lower tier 15 indicated at 36 is provided with a blind hole 38 for the slip fit connection to the stud 11. As seen more clearly in schematic FIG. 4, the hole 38 is formed by a primary, secondary and tertiary drilling step on three different centers shown at 40, 41 and 42. The centers as seen in FIG. 4 are vertically aligned and yet spaced. The drill or diameter on each center also varies with the diameter on the upper center 40 being the largest. The intermediate center 41 has an intermediate diameter, and the bottom or lower center 42 has the smallest diameter.

Typically, stud sizes may be either ⅝" or 1" and the intermediate and smaller lower diameter are designed to accommodate these stud sizes. The center 41 may be approximately 0.160"0 the center 40, while the center 42 may be approximately 0.260" lower than the intermediate center 41. The center and sizes of the drill present a blind hole accommodating the stud in a slip-fit which is formed with a number of different circumference arcs. The largest arc shown at the top at 45 forms the majority of the wall of the hole and is unthreaded. The intermediate diameter forms two smaller circumference arcs shown at 46 and 47 which are positioned symmetrically on each side of the lowermost circumference arc 48 formed by the center 42. Only the smaller circumference arcs 46, 47 and 48 are threaded. The arcs 46 and 47 are provided with threads which match the threads on the larger or 1" stud. The smaller circumference arc at the center bottom indicated at 48 is provided with threads which match the smaller or ⅝" stud, for example. The edge of the entire hole is chamfered as indicated at 49 in FIGS. 2 and 3.

It is noted that the three vertically aligned centers 40, 41 and 42 are in alignment with the axes of tapped jam screw holes 50 and 51 in the upper surface 31 of the lower tier. These holes accommodate respective jam screws 52 and 53, respectively, seen in FIGS. 1, 5 and 6 which act as screw jacks. Each jam screw is provided with a hexagonal recessed head 54 permitting the screws to be tightened with an alien wrench, for example.

Figure 5:
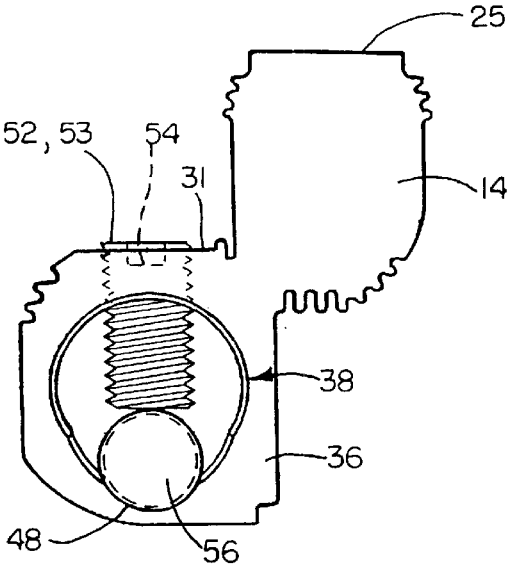
FIG. 5 is an end view of the connector fastened to a smaller transformer stud.
Figure 6:
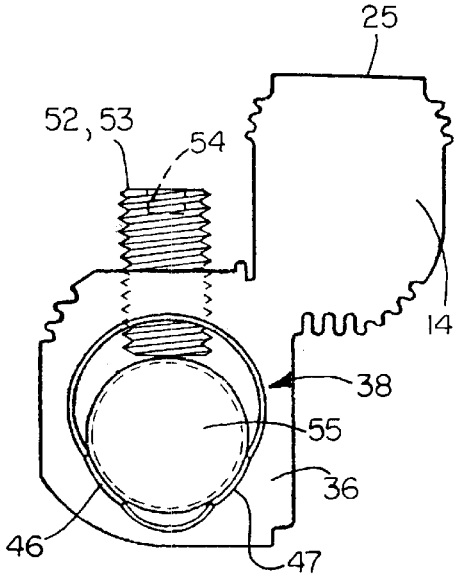
FIG. 6 is the same view with the connector mounted on a larger stud.

The larger circumference being unthreaded permits the connector quickly to be slipped over the threaded stud regardless of size with the jam screws retracted. As illustrated in FIGS. 5 and 6, the tightening of the jam screws will clamp the larger stud seen at 55 against the threaded circumference arcs 46 and 47 symmetrically on each side of the circumference arc 48. Since the threaded portions of the circumference arcs 46 and 47 match the threads on the stud 55, the tightening of the jam screw provides a large surface area of precision contact between the connector and the stud threads.

For the smaller studs such as seen at 56 in FIG. 5, the jam screws are simply tightened down further to press the stud into the circumference arc 48 or cusp which intersects the arcs 46 and 47 to provide the intimate contact between the threads of the stud 56 and the internal threads on the arc 48. With the same blind hole, the connector may readily be connected to either size stud, and with the meshing matching threads, a large surface area of precision contact is provided which provides both a stable connection and an efficient cool running and long service life connection.

It is believed apparent that if a hole for the smaller stud is provided in the smaller end face of the upper tier 14, the two conductor ports 19 and 20 would be sacrificed. Instead of six conductor ports, the connector would then only have four. Also, if the connector hole were included in the opposite end, again either the connector would have to be longer or ports sacrificed. As indicated, the longer connectors increase the cantilever of the connection and the instability of the connection. It will also be appreciated that the connector illustrated may be provided in either a right hand or left hand version. A right hand version would be the mirror image of what is seen in FIG. 1 or FIG. 2 with the slip-fit blind hole for the transformer stud simply being on the opposite end.

Figure 7:
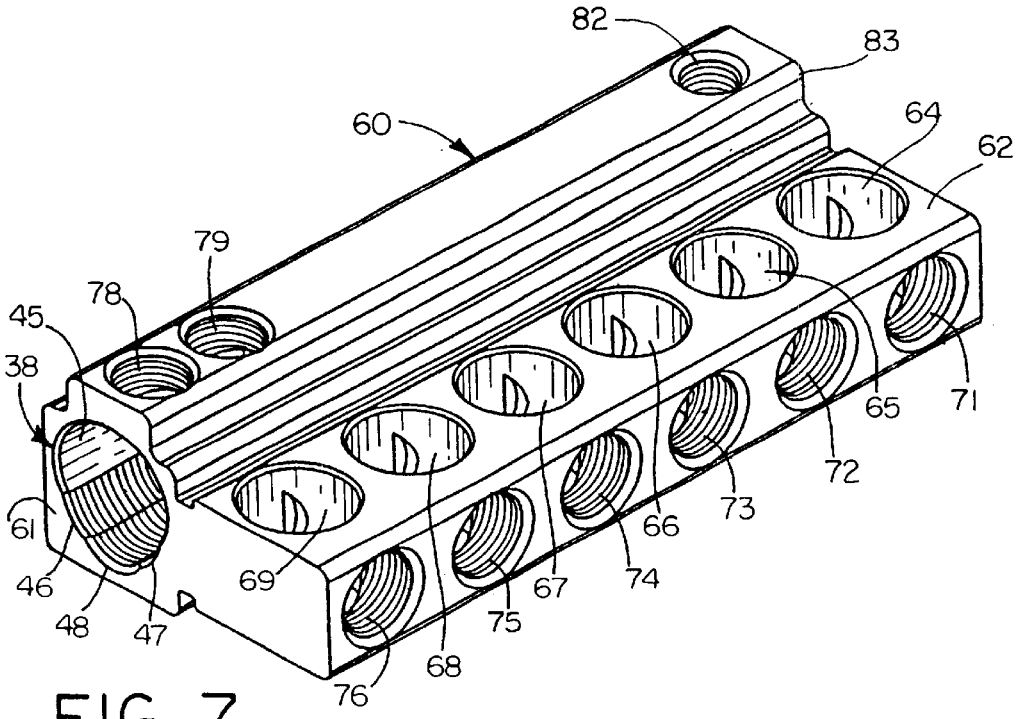
FIG. 7 is a perspective view of another form of connector in accordance with the present invention.

It will be appreciated that the tiered connector seen in FIGS. 1–6 may be provided in different sizes and lengths, and that the invention is also applicable to other types of connectors, an example being seen in FIG. 7. The connector of FIG. 7 illustrated generally at 60 includes a main body 61 and a somewhat offset smaller body 62 which is parallel to the main body. The offset body includes transverse conductor ports 64, 65, 66, 67, 68 and 69 with associated perpendicular tapped holes 71, 72, 73, 74, 75 and 76, respectively. The main body may be provided with two tapped holes 78 and 79 for jam screws for forcing a transformer stud against the threaded sections 46, 47 and 48 of the slip-fit blind hole 38, which is in all respects identical to the slip-fit connection hole seen in FIGS. 2–6. The larger arc 45 is unthreaded.

The opposite end of the main body may be provided with a set screw tapped hole 82 for a street light connection, for example, in the opposite end 83.

It will be appreciated that the dimensions given above are for specific size studs, and that other sizes and dimensions are applicable, as well as more than three centers for more than two sizes. While it is preferred that the centers be aligned vertically with the jam screws, it will be appreciated that any alignment may be employed.

It will now be seen that there is provided a slip-fit secure transformer stud connector resulting in an efficient cool running connection which can readily be made with different size transformer studs, and which results in considerable cost savings for stocking purposes, while providing increased connection capacity.

To the accomplishment of the foregoing and related ends, the invention then comprises the features particularly pointed out in the claims, these being indicative, however, of but a few of the various ways in which the principles of the invention may be employed.

We claim:

1. An electrical connector for attachment to a transformer stud comprising an electrically conducting connector body having a blind stud receiving hole therein adapted to receive and accommodate at least two different size studs, said hole having circumference arcs formed by arcs having at least three centers, each of a different radius.

2. An electrical connector as set forth in claim 1 wherein said centers are offset from each other and in alignment.

3. An electrical connector as set forth in claim 2 including jamb screw means having an axis on said alignment operative to force a stud into one or another of the arcs formed by the smaller radii.

4. An electrical connector as set forth in claim 1 wherein the smaller radii arcs are respectively threaded to match the threads on the respective studs accommodated.

5. An electrical connector as set forth in claim 1 wherein the largest radius arc is unthreaded.

6. An electrical connector as set forth in claim 1 wherein an intermediate radius forms two arcs.

7. An electrical connector as set forth in claim 6 wherein the arc formed by a radius smaller than the intermediate radius is positioned between the two arcs.

8. An electrical connection as set forth in claim 7 wherein the arc formed by the smaller radius intersects the two arcs.

9. An electrical connection as set forth in claim 1 wherein said connector is tiered providing a plurality of connections in at least two rows, and said hole is in the end of one of said rows.

10. A method of making a slip-fit transformer stud electrical connector comprising the steps of forming a blind hole in an end of a connector body to form a cylindrical wall, forming a secondary hole offset from the center of said blind hole and thus removing part of said wall to form a first cylindrical recess in said cylindrical wall, forming a tertiary hole offset from the center of said secondary hole to form a symmetrical second cylindrical recess in said first cylindrical recess, said first and second cylindrical recesses being formed to match two different size transformer studs.

11. A method as set forth in claim 10 wherein said transformer studs are threaded, and forming matching threads on said first and second recesses.

12. A method as set forth in claim 11 wherein the centers of each said hole are in alignment.

13. A method as set forth in claim 12 including the step of providing jack means in said body movable on said alignment to force the matching threads together once the stud is within the blind hole.

14. A method as set forth in claim 13 wherein said jack means comprises a jam screw threaded in said body extending on said alignment.

15. A method as set forth in claim 14 wherein said body is tiered, and said blind hole is in one of said tiers.

* * * * *